US011959279B2

(12) United States Patent
Caselli et al.

(10) Patent No.: US 11,959,279 B2
(45) Date of Patent: Apr. 16, 2024

(54) ROOF TILE AND A ROOF COVERING

(71) Applicant: Dal-Tile Corporation, Dallas, TX (US)

(72) Inventors: Claudio Caselli, Dallas, TX (US); Rahul Patki, Dallas, TX (US); Terry Adams, Dallas, TX (US); Raul Rodriguez, Dallas, TX (US)

(73) Assignee: Dal-Tile, LLC, Dallas, TX (US)

( * ) Notice: Subject to any disclaimer, the term of this patent is extended or adjusted under 35 U.S.C. 154(b) by 0 days.

(21) Appl. No.: 17/792,606

(22) PCT Filed: Feb. 9, 2021

(86) PCT No.: PCT/US2021/017170
§ 371 (c)(1),
(2) Date: Jul. 13, 2022

(87) PCT Pub. No.: WO2021/163009
PCT Pub. Date: Aug. 19, 2021

(65) Prior Publication Data

US 2023/0067437 A1 Mar. 2, 2023

Related U.S. Application Data

(60) Provisional application No. 62/975,363, filed on Feb. 12, 2020.

(51) Int. Cl.
*E04D 1/16* (2006.01)
*E04D 1/00* (2006.01)

(52) U.S. Cl.
CPC ..... *E04D 1/16* (2013.01); *E04D 1/2918* (2019.08); *E04D 1/2956* (2019.08)

(58) Field of Classification Search
CPC .... E04D 1/16; E04D 1/18; E04D 1/26; E04D 1/265; E04D 1/29; E04D 1/2918; E04D 1/2928; E04D 1/2956; E04D 1/2963; E04D 2001/3423
See application file for complete search history.

(56) References Cited

U.S. PATENT DOCUMENTS 5,362,342 A * 11/1994 Murray ..... E04D 1/36 156/578
5,935,885 A * 8/1999 Hnat ..... C03B 3/02 588/256

(Continued)

FOREIGN PATENT DOCUMENTS

DE 102009012669 B3 9/2010
EP 1038689 A1 9/2002

(Continued)

OTHER PUBLICATIONS

Foreign Communication from Related Application—International Search Report and Written Opinion of the International Searching Authority, International Application PCT/US2021/017170, dated Apr. 28, 2021, 8 pages.

(Continued)

*Primary Examiner* — James M Ference
(74) *Attorney, Agent, or Firm* — Ryan D. Jenlink; Conley Rose, P.C.

(57) ABSTRACT

A roof tile comprising a ceramic body and a reinforcing element attached to a lower surface of the ceramic body.

20 Claims, 4 Drawing Sheets

(56) References Cited

U.S. PATENT DOCUMENTS 6,248,271 B1 * 6/2001 Graham ..... B28B 7/366 264/225
7,596,919 B1 * 10/2009 Vande Hey ..... E04D 1/2916 52/630
8,468,754 B2 * 6/2013 Railkar ..... E04D 1/26 52/173.3
8,557,083 B2 * 10/2013 Paganelli ..... E04F 13/142 52/223.6
10,316,518 B2 * 6/2019 Patki ..... E04D 1/28
10,677,275 B1 * 6/2020 Caselli ..... F16B 5/008
10,941,572 B2 * 3/2021 Patki ..... E04D 1/30
11,542,710 B2 * 1/2023 Patki ..... E04D 1/04
2008/0110123 A1 * 5/2008 Oberoi ..... E04D 1/2916 52/309.4
2010/0154339 A1 * 6/2010 Paganelli ..... E04F 13/142 52/390
2010/0239816 A1 * 9/2010 Kinkade ..... B29C 70/60 264/129
2011/0281066 A1 11/2011 Andrews et al.
2012/0085053 A1 * 4/2012 Barone ..... E04D 1/04 52/302.1
2012/0085055 A1 * 4/2012 Earl ..... E04F 13/14 52/309.1
2012/0090258 A1 * 4/2012 Alford ..... E04F 15/087 52/309.1
2014/0134392 A1 * 5/2014 Ray ..... E04F 13/147 428/116
2015/0121779 A1 * 5/2015 Arguelles ..... E04D 1/045 52/173.1
2015/0218817 A1 * 8/2015 Pisani ..... E04D 1/14 29/428
2016/0319554 A1 * 11/2016 Thiers ..... B44C 5/06
2017/0218632 A1 * 8/2017 Patki ..... B28B 11/001
2018/0218632 A1 * 8/2018 Ivey ..... B44C 1/00
2019/0099915 A1 * 4/2019 Adams ..... C04B 40/0067
2019/0319577 A1 * 10/2019 Hu ..... E04D 11/002
2020/0009711 A1 * 1/2020 Rodriguez ..... B25C 7/00
2020/0011071 A1 * 1/2020 Patki ..... B32B 9/045
2020/0048909 A1 * 2/2020 Patki ..... E04D 1/30
2021/0078279 A1 * 3/2021 Giannazzo ..... B30B 15/30
2021/0079666 A1 * 3/2021 Caselli ..... B32B 27/36
2021/0300099 A1 * 9/2021 Caselli ..... B41M 5/0047
2021/0348397 A1 * 11/2021 Caselli ..... B32B 27/36
2022/0251840 A1 * 8/2022 Patki ..... E04D 1/28
2022/0251841 A1 * 8/2022 Patki ..... E04D 1/2918
2023/0067437 A1 * 3/2023 Caselli ..... E04D 1/265

FOREIGN PATENT DOCUMENTS

EP 3342951 A1 * 7/2018 ..... E04D 1/18
FR 2606440 A1 * 5/1988
WO 2015092745 A1 6/2015
WO 2021163009 A1 8/2021

OTHER PUBLICATIONS

U.S. Appl. No. 62/975,363, entitled "a Roof Tile and a Roof Covering", filed Feb. 12, 2020, 56 pages.

* cited by examiner

ROOF TILE AND A ROOF COVERING

CROSS-REFERENCE TO RELATED APPLICATIONS

This application is a national stage entry, under 35 U.S.C. § 371, of PCT/US2021/017170 entitled "A ROOF TILE AND A ROOF COVERING" and filed on Feb. 9, 2021, which claims priority to U.S. Provisional Application No. 62/975,363 filed on Feb. 12, 2020, the disclosure of each of which is herein incorporated by reference in its entirety.

TECHNICAL FIELD

The present invention relates to a system for installing roof tile comprising a ceramic body, preferably a ceramic body, and to a method for installing said roof tile. The invention further relates to a porcelain roof tile, i.e. a roof tile comprising a ceramic body and to a roof covering comprising porcelain roof tiles.

BACKGROUND

US 2017/0218632 disclose roof tiles having a body made of porcelain. Such kind of materials improve the weather/frost resistance and durability of the roof tile with respect to other kinds of ceramic materials like red body ceramic, for example terracotta.

In order to form a roof covering, such roof tiles shall be nailed or screwed on a roof structure. Due to the brittleness of porcelain, hammering for nailing the roof tile to a supporting structure can cause breakage of the body thereof. Therefore, during installation of the roof covering a considerable number of roof tiles can be wasted thereby increasing the cost of the roof covering itself, as well as the workload of the installer. Moreover, in use the roof tiles are exposed to storms and hail damage. The ceramic body of roof tile described in US 2017/0218632 needs to be at least 12 mm thick in order to be certified Class IV hail resistance. As a consequence said thick porcelain roof tile are relatively heavy impacting on production, transport and installation cost.

The present invention aims in the first place at an alternative roof tile, of the aforementioned type, whereby, according to various preferred embodiments, solutions are offered for problems with roof tiles known in the art.

BRIEF SUMMARY OF THE INVENTION

In one aspect, the present invention provides a roof tile comprising: a ceramic body; and a reinforcing element attached to a lower surface of the ceramic body.

In some embodiments, the reinforcing layer comprises a resin. In some embodiments, the resin comprises a viscosity less than 1000 mPas at 20° C. In some embodiments, the resin comprises a tensile strength between 50 and 90 MP. In some embodiments, the resin comprises a hardness above 50 Shore D. In some embodiments, the resin is provided in an amount more than 150 g/sqm. In some embodiments, the resin comprises epoxy, polyurethane, acrylic and/or polyester resin.

In some embodiments, the roof tile comprises a support layer below the reinforcing layer. 9 In some embodiments, the support layer comprises a solid polymer composite (SPC). 10. In some embodiments, the roof tile comprises at least an attachment hole provided in the support layer. In some embodiments, the support layer comprises a thickness less than 4 mm. In some embodiments, the support layer comprises locking elements adapted to provide a mechanical coupling with locking elements of an adjacent roof tile. In some embodiments, the locking elements are configured to prevent vertical movement between the roof tile and the adjacent roof tile.

In some embodiments, the reinforcing layer comprises a metal plate. In some embodiments, the metal plate is attached to the bottom of the ceramic body in a stretched state so that after releasing the stretch the metal plate compresses the ceramic body. In some embodiments, the metal plate comprises a thickness less than 1 mm, preferably less than 0.5 mm, more preferably less than 0.2 mm.

In some embodiments, the roof tile comprises at least one attachment hole provided in the ceramic body.

In some embodiments, the ceramic body comprises a thickness less than 8 mm, preferably less than 6 mm. In some embodiments, the roof tile comprises a weight less than 20 kg/sqm. In some embodiments, the roof tile comprises a rectangular shape and a top décor imitating a plurality of roof tiles.

These and other objects, features and advantages of the present invention will become more apparent upon reading the following specification in conjunction with the accompanying description, claims and drawings.

BRIEF DESCRIPTION OF THE FIGURES

The accompanying Figures, which are incorporated in and constitute apart of this specification, illustrate several aspects described below.

DETAILED DESCRIPTION OF THE INVENTION

Figure 1:
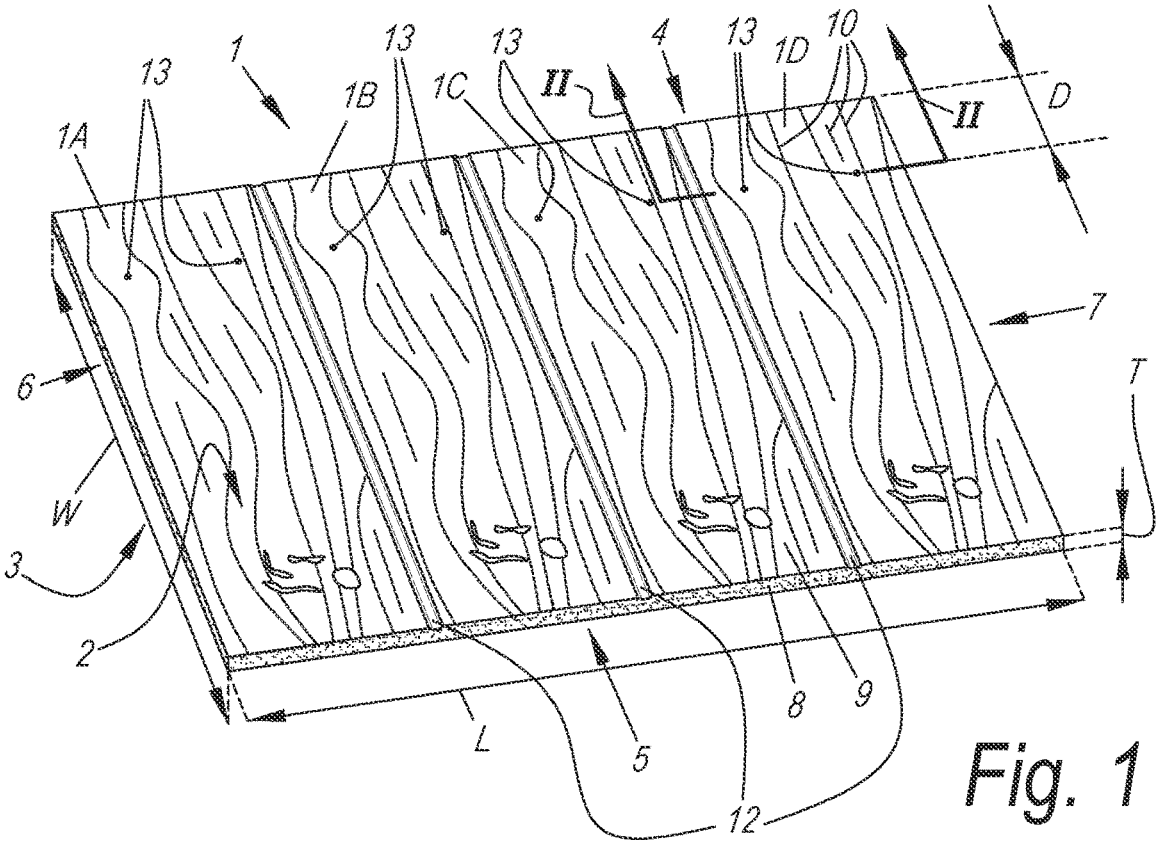
FIG. 1 represents a perspective view of a roof tile according to a first embodiment of the present invention, with a view on the front face of the roof tile.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

As used herein, the term "and/or" may mean "and," it may mean "or," it may mean "exclusive-or," it may mean "one," it may mean "some, but not all," it may mean "neither," and/or it may mean "both." The term "or" is intended to mean an inclusive "or."

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

The present invention, according to a first independent aspect, relates to a roof tile comprising a ceramic body and a reinforcing layer attached to a lower surface of said ceramic body.

In accordance with the invention, the reinforcing layer can be realized according to several measures. According to a first measure of the invention, the reinforcing element comprises a resin, for example can be constituted by a resin. The resin can be a thermosetting resin or thermoplastic resin. Examples of thermosetting resin are epoxy, polyurethane, unsaturated polyester, vinyl ester, cyanoacrylate. Examples of thermoplastic resin are hot melt, reactive hot melt, polyester thermoplastic, acrylic resin, vinyl etc. Preferably the resin is a rigid resin. In fact, the inventors have found that a rigid resin, rather than flexible resin, shows a higher absorption of the energy rather than flexible resin. In particular, according to a preferred embodiment of the invention the reinforcing element comprises an epoxy resin. In some embodiment of the invention, the resin is a bicomponent resin, i.e. a thermosetting resin obtained by curing at low temperature (for example at room temperature) a mixture of two components, namely a resin and a hardener. When the two components of the resin are mixed together the curing reaction starts so that it is not necessary to activate the cure by providing external energy, like heat, UV or EB radiation. Said external energy could be optionally provided in order to accelerate the curing process.

Moreover, according to a preferred embodiment, the resin material permeates a lower surface of the ceramic body and in particular an open porosity thereof. The inventors have found that, due to this solution, the impact resistance of the roof tile, is highly increased. Moreover, in this way it is possible to improve the impact resistance of the roof tile without the necessity to add further rigid or resilient reinforcing elements like rubber layer, fiberglass or metal sheets. In fact, the resin permeating the pores of the ceramic body substantially improves the transmission and dissipation of the impact stress through the roof tile so that a lower portion of said energy is absorbed by the ceramic body improving the impact resistance thereof. Since it is not necessary to add rigid reinforcing elements, the resulting roof tile is lighter and thinner. Moreover, the resin constitutes a hindrance to the propagation of cracks in the ceramic body. Furthermore, in case of superficial cracks of the ceramic body, the reinforcing layer keeps the ceramic body itself coherent, and preferably compacted, thereby disguising the visual appearance of the superficial cracks.

According to a preferred aspect of the invention the resin comprises a viscosity at 20° C. less than 1000 mPas, preferably less than 800 mPas, more preferably less than 600 mPas, for example approximately 400 mPas. Within the scope of the invention viscosity means the viscosity of the uncured resin, for example the viscosity of the mixture of the two components before the completion of the curing, i.e. during the so-called pot life. In fact, the inventors have found that if the resin is sufficiently fluid, during its application onto the back of the ceramic body, it can permeate the pores thereof. In practice, when the resin permeates the pores of the ceramic body it substantially forms a "composite polymer-ceramic layer" that significantly improves the impact strength of the roof tile. Moreover, due to the reinforcing layer here described it is possible to improve the impact resistance and fatigue behavior of a relatively thin ceramic body, thereby reducing the weight of the roof tile and improving the maneuverability. It is noted that, according to a preferred solution the resin is in a substantially liquid state during the manufacturing process of the roof tile. It is possible that the resin is in a pasty or gel state during the manufacturing process, for example showing a thixotropic behavior in order to reach a sufficient fluidity to permeate the pores of the ceramic body under predetermined process conditions, for example during a pressing step.

Preferably the resin may also show a shrinkage, after curing, comprised between 0.5 and 15% for example between 1 and 10%. The inventors have surprisingly found that a resin showing this characteristic during its curing retires significantly. Since during curing the resin is the only component of the roof tile that shrinks, it compresses the ceramic body disposed above thereby reinforcing the ceramic body itself. This effect can be further enhanced if the resin permeates the lower surface of the ceramic body. In fact, if the resin of the intermediate layer permeates the lower surface of the ceramic body the strong bonding within the two layers helps the compressive action of the resin. Moreover, this reinforcing mechanism due to the compressive action of the resin may join the reinforcing action due to the filling of the pores and the improved stress transfer mechanism.

This compressive effect is evident by measuring the bowing of the roof tile, i.e. the planarity deviation thereof. Usually, the planarity deviation of the ceramic body is reflected into the bowing of the whole roof tile. The inventors have found that after curing of the resin the roof tile shows a planarity deviation which is higher than the planarity deviation of the sole ceramic body before application of the resin. This means that the ceramic body is compressed and reinforced. Therefore, according to a preferred embodiment, after gluing the ceramic body a planarity deviation less than 1.5 mm, preferably less than 1 mm, more preferably less than 0.8 mm. Within the context of the present application, the planarity deviation is defined as the height difference between the extremal portion and the central portion of an edge of the ceramic body. In particular within the scope of the present invention the planarity deviation is measured by placing the extremes of one edge of the ceramic body, on a horizontal plane and measuring the distance between the middle of the edge from that horizontal plane. According to an embodiment of the invention, upon this compressive effect the planarity deviation of the roof tile after gluing is at least 1%, preferably at least 5%, for example at least 10% higher than the planarity deviation of the ceramic body before gluing.

The inventors have also found that preferably the resin may be free from fillers, like mineral fillers. In fact, the inventors have found that the presence of fillers if on one hand improves mechanical properties of the resin as such, on the other hand increases the viscosity of the resin thereby forming an obstacle to the permeation of the ceramic body.

The resin preferably comprises a tensile strength between 50 and 90 MPa, more preferably between 60 and 80 MPa, for example 75 MPa. It is noted that the resin preferably comprises a compressive strength between 90 and 130 MPa, more preferably between 100 and 120 MPa, for example 110 MPa. The inventors have found that such strength is sufficient to provide a rigid matrix for the composite polymer-ceramic layer that allows dissipation of the impact energy. It is also noted that the resin may preferably show a hardness value of at least 50 measured on a Shore D scale. Preferably the resin may comprise a Young modulus comprised above 0.5 GPa, more preferably above 1 GPa. It may also be preferable that the Young modulus is below 3 GPa, more preferably below 2 GPa. For example the Young modulus can be comprised between 1 GPa and 1.5 GPa, preferably around 1.3 GPa.

Preferably the resin covers at least a portion of the lower surface of the ceramic body, for example the majority, i.e. at least 50 percent, of the lower surface of said ceramic body. More preferably the resin covers 80 percent or more of the lower surface of the ceramic body, for example it covers the 100 percent of the lower surface of the ceramic body so that the effect of distribution and dissipation of the impact energy is obtained for an impact occurring in any point of the ceramic body.

The resin is preferably provided onto the lower surface of the ceramic body in an amount greater than 50 g/sqm, more preferably greater than 100 g/sqm, even more preferably greater than 150 g/sqm for example 220 g/sqm so that the resin is present in an amount that is sufficient to fully permeate the open pores of the lower surface of the ceramic body. It is also preferable that the resin is provided in an amount less than 300 g/sqm, more preferably less than 250 g/sqm.

It is also preferable that the resin is provided in an amount sufficient to overflow from the open porosity of the ceramic body in order to act as a glue for a support layer. In other words, it is preferable that the resin partially permeates the open porosity of the ceramic body and partially coats the lower surface thereof for forming an intermediate layer between the ceramic body and said support layer and improving the transfer of energy. Said effect of transfer of energy is further improved if the support layer is directly fixed to the intermediate layer and, in particular, to said portion of the resin that coats the lower surface of the ceramic body, so that the intermediate layer acts as an adhesive layer that bonds together the ceramic body and the board.

Although according to a preferred embodiment of the first possibility the reinforcing layer is free from any filler or rigid element, it is not excluded that according to an alternative embodiment the reinforcing element can comprise a rigid element for example at least partially embedded into the resin material. The rigid element may comprise fibers like glass fibers carbon fibers, polymeric fibers, for example aramid or polyamide fibers, or ceramic fibers, for example boron or silicate fibers. The fibers may be woven or non-woven fibers, for example with fibers disposed at different orientations, and may be in in form of mat, fleece or cloth. Fillers can also comprise mineral such as calcium carbonate, talc, silica, mica, wollastonite, ash and others. It is to be noted that in case of presence of rigid element the reinforcing effect of the reinforcing layer can be caused by the sole presence of the rigid element or by a combination of the effects provided by the rigid element and the resin.

According to a second possibility for providing a reinforcing layer, the reinforcing layer may comprise a metal sheet, for example a steel or aluminum sheet attached to the lower surface of the ceramic body. Preferably, the metal sheet is configured to establish a compressive state in the ceramic body. In this way, since the ceramic body is in a compressive state, the impact resistance is strongly improved, because the compression obstacles the propagation of cracks and helps in disguising the visual effect of superficial cracks. To achieve this goal, the metal sheet is first stretched, for example by means of a mechanical or thermal stretching, and then is bonded to the ceramic body while the metal sheet is in the stretched state. Subsequently, the stretch is released, by interrupting the mechanical solicitation or by cooling the metal sheet itself, thereby establishing a compressive state in the ceramic body. For example, the metal sheet has a coefficient of thermal expansion higher than the coefficient of thermal expansion of the ceramic body. Due to this solution, the reinforcing element is heated to a stretched state, and then it is bonded to the ceramic body while it is still in the stretched state and subsequently it is cooled down to retract and put the ceramic body in compression.

In a preferred embodiment of this second possibility, the metal sheet can have a thickness less than 1 mm, preferably less than 0.5 mm, even more preferably less than 0.2 mm. The metal sheet may have a thickness greater than 0.05 mm, preferably greater than 0.1 mm.

Preferably the metal sheet can comprise an anticorrosion alloy, like stainless steel, or comprise a anticorrosion coating, for example of zinc, chrome, paint, glaze or a plastic film.

The metal sheet can be attached to ceramic body with an adhesive layer. Said adhesive layer can comprise one or more glue. The resin can be a thermosetting adhesive or thermoplastic adhesive. Examples of thermosetting adhesive are epoxy, polyurethane, unsaturated polyester, vinyl ester, cyanoacrylate, hot melt, reactive hot melt. Examples of thermoplastic adhesive are hot melt, polyester thermoplastic, acrylic resin, vinyl etc. It is noted that said adhesive can have properties as those described for the resin in relation to the first possibility for the reinforcing layer. It is preferred that the adhesive is provided in an amount less than 150 g/sqm, preferably less than 50 g/sqm.

According to a preferred embodiment of the present invention the ceramic body is made of porcelain since porcelain provides for a better frost and mechanical resistance with respect to other ceramic material. Therefore, the combination of a ceramic body together with other feature of the system provides for a system that minimizes the consumption of roof tiles, in other words minimizes the breakage of roof tile.

Although a ceramic body made of porcelain is a preferred embodiment, it is noted that the system may alternatively comprise a roof tile having a body of a red ceramic material, clay ceramic or any other material used for roof covering, especially brittle material like, for example, natural stone or slate.

According to a preferred aspect of the invention the ceramic body may comprise, at least in correspondence of its lower surface, an open porosity adapted to allow the resin to permeate the ceramic body itself. Thus, according to a preferred embodiment of the invention, the ceramic body may comprise an apparent porosity between 0.1% and 10% determined according to ASTM C373, more preferably between 2% and 8%, for example 6%. Since, the pores of the material, especially the closed pores may represent weak points of the material itself, it is preferable that the ceramic body comprises an apparent porosity lower than 15%, preferably lower than 10% measured according to ASTM C373. Furthermore, the ceramic body may preferably have a volume of the open pores comprised between 0.01 cc (cubic centimeter) and 1 cc, more preferably between 0.10 cc and 0.90 cc, for example 0.60 cc. The abovementioned ranges and values of apparent porosity provide the optimum balance between intrinsic mechanical properties of the ceramic body and the resin permeability thereof thereby providing the best bonding between the resin without affecting the intrinsic mechanical properties of the ceramic body. In this way the pores are big enough to be filled by the resin while at the same time they are sufficiently small to avoid compromising the mechanical properties of the ceramic body.

Preferably the roof tile further comprises a glaze coating, which is situated above said ceramic body, i.e. at least on the upper surface of the ceramic body. Hereby, it is noted that the glaze coating is not necessarily situated directly above the ceramic body, however, this is preferably the case. The glaze coating contributes to the overall weather and frost resistance of the roof tile, since water can mainly only be absorbed via the edges of the roof tile. Another advantage is that the roof tile, due to the presence of the glaze coating, may be provided with a variety of textures, designs and colors. Other advantages that may be obtained by the presence of the glaze coating are the prevention or at least the minimization of moss grow, easy cleanability and/or UV-resistance.

Further, according to an embodiment of the invention, the glaze coating may cover at least one edge of the roof tile, for example three edges of the roof tile. In particular, since the roof tiles are destined to be installed partially overlapping each-other, there is always one edge, namely an upper edge, that in use is placed below another roof tile and that consequently is not be exposed to weather and water. On the contrary the other three edges are exposed to weather and water. By providing a glaze coating on said exposed edges is improved the overall weather and frost resistance of the roof tile. Preferably said exposed and glaze edges may be rounded or chamfered edges, for example they may be bullnose edges.

In a preferred embodiment, the glaze coating comprises a glaze layer of uniform color, which, in case of said glaze coating comprising a print, is situated below said print. As advantage, the glaze layer of uniform color may hide imperfections in the upper surface of the ceramic body. Although the glaze layer of uniform color is preferably of a white, beige or grey color, the glaze layer may be of another color as well. In the latter case, the advantage may be obtained that the ink lay-up, which is needed for obtaining the desired colors in the aforementioned print, can be lowered.

Preferably, the glaze coating comprises a transparent or translucent glaze layer, which, in case of said glaze coating comprising a print, is arranged over said print. By having such glaze layer, the advantage may be obtained that the print can be protected from wear. Other advantages that may be obtained by the use of such transparent or translucent glaze layer are the minimization of moss growth, easy cleanability and/or UV-resistance. It is noted that the aforementioned glaze coating may be a so-called wet or dry glaze. In a particular embodiment, the color or appearance of the ceramic body substantially matches the color or appearance of the front face of the roof tile. As an advantage, no major color or appearance differences are visible between for example the edges of the ceramic body and the front face of the roof tile.

In a preferred embodiment, said glaze coating comprises a décor, which may simulate a natural product such as stone, natural slate or wood. In the latter case, the décor may show wood grains or wood nerves. As advantage, the roof tile may have the look of a natural product such as natural slate or wood, while being provided with better weather and frost resistance than roof elements that are actually made of such materials. In a particular embodiment, said décor comprises a print. In other words, the décor, or at least part of the décor, is provided by means of a printer or printing machine. Various techniques may be used to provide said print, such as screen printing, rotary serigraphy or digital printing, the latter technique being the preferred one. In case of digital printing, an inkjet printer may be used, which may be of the single pass type. In particular, a device similar to the one disclosed in EP 1 038 689 A1 may be used, wherein each roof tile is printed separately with a single pass of the roof tile underneath the fixed print heads of the device. With such device, the possibility is offered to print in certain areas of the upper surface of the roof tile. For example, the device may be used to print multiple images, each of these images being present in respective areas of the upper surface of the roof tile. These images may be separated from each other by means of intermediate lines, transitions or edges, which are not necessarily provided by means of printing, although this is not excluded.

Preferably, the front face of the roof tile represents or forms an image of a plurality of roof tiles. In such case, the roof covering may have the appearance of a conventional one, however, with the advantage of being composed of fewer roof tiles. That the roof covering is composed of fewer roof tiles allows reducing the overall risk at water penetration. Indeed, the number of joints, present between the roof tiles in the roof covering, in which water might penetrate, may be minimized. For forming such kind of front face, a décor with multiple images may be applied, e.g. with each image representing a single roof tile. These multiple images may be provided by respectively printing in certain areas of the upper surface of the roof tile, as previously described. Thereto, a device such as the device known from EP 1 038 689 A1 may be applied. In such front face, the borders or transitions between adjacent images of roof tiles may be represented by means of a relief.

Preferably, the front face of the roof tile represents or forms an image of a plurality of roof tiles. In such case, the roof covering may have the appearance of a conventional one, however, with the advantage of being composed of fewer roof tiles. That the roof covering is composed of fewer roof tiles allows reducing the overall risk at water penetration. Indeed, the number of joints, present between the roof tiles in the roof covering, in which water might penetrate, may be minimized. For forming such kind of front face, a décor with multiple images may be applied, e.g. with each image representing a single roof tile. These multiple images may be provided by respectively printing in certain areas of the upper surface of the roof tile, as previously described. Thereto, a device such as the device known from EP 1 038 689 A1 may be applied. In such front face, the borders or transitions between adjacent images of roof tiles may be represented by means of a relief. For example, as previously described, these borders or transitions may be formed by means of depressions in the upper surface of the roof tile, situated between the images of the roof tiles.

In case of the glaze coating being provided with a print, it is advantageous that the ceramic body substantially matches the general color or appearance of that print. Indeed, in that way, any substantial contrast between the edges of the ceramic body and the print may be excluded. For accomplishing that goal, the ceramic body may be provided with one or more color pigments. The pigments may then be chosen such that they provide the ceramic body with a color or appearance that substantially matches the color or appearance of the front face of the roof tile. It is noted that, in general, the ceramic body may be provided with one or more color pigments, irrespective of the ceramic body substantially matching the color or appearance of the front face of the roof tile.

According to an alternative embodiment wherein the roof tile comprises a ceramic body, the roof tile may be free from said glaze coating and the body may comprise a body décor. For accomplishing that goal, the ceramic body may be provided with one or more color pigments. The pigments may then be provided into the body randomly or according to a predetermined pattern or drawing. In this way the body décor may represent a natural product such as natural slate or wood. The body décor may also represent multiple images substantially in the same manner described above with reference to the glaze coating.

In an embodiment, the upper surface of the roof tile is provided with a relief, which preferably is formed by a plurality of excavations present in said upper surface of the roof tile. By the relief, the texture of the roof tile, at the upper surface thereof, may simulate the texture of a natural product such as stone, natural slate or wood. In the latter case, the relief may for example simulate the texture of wood grains or wood pores.

The relief or at least part of the relief may also concern one or more chamfers present at the upper surface of the roof tile, which may be provided at one or more edges of the roof tile. For example, the relief or at least part thereof may concern a chamfered perimeter of the roof tile, for example in the form of a bullnose edge. In case of a décor with multiple images, the relief may also be used to represent lines or transitions between these images. For example, these lines or transitions may be represented in the form of depressions in the upper surface of the roof tile, situated between the images. Various possibilities may be applied for providing the relief. Preferably, the relief is formed in the upper surface of the ceramic body, in which case the relief manifests itself through the glaze coating up to the upper surface of the roof tile. Alternatively, the relief or at least part of the relief may be formed in the glaze coating, such that it is situated substantially or completely above the ceramic body. In case of said glaze coating being provided with a print, said relief may be performed "in register" with said print, which means that the relief is in alignment with the print. By having the relief "in register" with the print, the natural look or appearance of natural products such as wood or natural slate is better simulated. For example, in case the print is a wood pattern with lines simulating wood grains, the relief may be formed by lines following the course of said lines of the printed wood pattern or by a plurality of successive dashes having a configuration following the lines of the printed wood pattern.

For having the relief being performed "in register" with the print, the techniques known from WO 2015/092745 A1 may be used.

In a particular embodiment, the lower surface of the roof tile, and in particular of the ceramic body, is flat. More in detail said lower surface is free from any structure or comprises a relief structure having a depth or a height less than 1 mm, preferably less than 0.5 mm, more preferably less than 0.2 mm. Due to this feature the adhesion between the ceramic body and the reinforcing layer is significantly increased.

Preferably, the thickness of the roof tile is less than 10 mm, for example less than 8 mm, more preferably less than 6 mm. The thickness can be greater than 1 mm, preferably greater than 3 mm. In fact, due to the reinforcing layer, it is possible to reduce the thickness of the ceramic body and thus reduce the weight of the roof tile itself.

Preferably the roof tile, may have a weight expressed in kg/sqm less than 20 kg/sqm, more preferably less than 15 kg/sqm, even more preferably less than 10 kg/sqm.

In a preferred embodiment, the ceramic body forms at least 50%, more preferably at least 75%, and still more preferably at least 90% of the thickness of the roof tile. In that way, the roof tile has optimal advantage of the beneficial characteristics of porcelain.

The inventors have found that the rooftile may be made relatively wide. For example, the length of the roof tile may be larger than its width. Also, not necessarily combined with the previous, the roof tile may be at least 350 mm wide and preferably at least 500 mm long. That the roof tile may be made relatively long, offers the advantage that the roof or roof covering may be composed of a relatively small amount of roof tiles, thereby minimizing the number of joints present in the roof covering and consequently the risk at water penetration. Within the scope of the present application the width of a roof tile is that dimension that in use is intended to be disposed horizontal, i.e. parallel to the roof ridge, whereas the length is that dimension that in use is intended to be disposed inclined according to the slope of the roof. It is to be noted that since due to the presence of the reinforcing layer, the thickness of the ceramic body as well as the weight thereof can be reduced, it is possible to further increase the dimensions of the roof tile, in particular of width and/or length, preferably length in such a way to further reduce the number of joints between the tiles.

The roof tile is preferably provided with at least one attachment hole. Such attachment hole is used to attach or fasten the roof tile to a roof structure or framework of the roof, said framework for instance being formed by battens. The attachment hole is a through hole.

As an advantage, the attachment hole allows a safe and secure installation of the roof tile, for example by using nails, screws or wires. Moreover, the attachment hole allows a simple and efficient way to install the roof tile.

In an embodiment, the attachment hole is present in at least the ceramic body of the roof tile. Accordingly, for example when using nails or screws, pressure is exerted onto the ceramic body for attaching it to the roof framework. Due to the ceramic body being made of porcelain, the risk at any damage or breakage of the roof tile, resulting from that pressure, may be minimized. The reinforcing layer further minimizes the risk of breaking the tile.

The attachment hole is preferably situated closer to the upper edge of the roof tile than to the lower edge of the roof tile. According to a preferred embodiment, as already described, said upper edge correspond to the length, i.e. the longest edge of the roof tile. The inventors have found that due to this solution the roof or roof covering may be composed of a relatively small amount of roof tiles, thereby minimizing the number of joints present in the roof covering and consequently the risk at water penetration. Still more preferably, the attachment hole is situated at a distance from the upper edge of the roof tile, as measured in the width direction of the roof tile, which is smaller than 0.25 times the width of the roof tile. As advantage, the extent of overlap between adjacent roof tiles in subsequent rows of the roof covering may be minimized.

Preferably, the roof tile is provided with a multiplicity of attachment holes, for example more than 2, preferably 4 or 6. According to a preferred embodiment of the invention, the attachment holes of said plurality are aligned parallel to the upper edge of the roof tile.

According to a preferred embodiment of the invention, the attachment hole comprises a first enlarged portion and a second narrow portion, wherein the first enlarged portion is disposed close to the upper surface of the roof tile. The first enlarged portion and the second narrow portion being coaxially each other. In this way, the enlarged portion defines a seat for the nail head and at the same time defines a guide for the centering element of the nail gun so that the nail can be properly positioned and directed into the hole minimizing the risk of damaging the roof tile.

The first enlarged portion is configured to be coupled with an ejecting nozzle of a nail gun, preferably with a centering element of the nail gun so that the nail may be properly placed and directed in order to reduce the impact strength acting on the roof tile on installation.

In a preferred embodiment the first and the second narrow portion of the attachment hole are provided with the glaze coating.

In a preferred embodiment, the roof tile comprises support layer, which is situated below the ceramic body. It is noted that the support layer is not necessarily situated directly below the ceramic body the reinforcing layer is disposed between the ceramic body and the support layer.

The support layer may be advantageously bonded to the ceramic body or to the reinforcing layer by means of an adhesive. In a preferred embodiment wherein the reinforcing layer is according to the first possibility, the resin forming the reinforcing layer is configured to act as the adhesive to bond the ceramic body. In a preferred embodiment wherein the reinforcing layer is according to the second possibility, the adhesive can be the same used for bonding the metal plate to the ceramic body.

The support layer may provide additional functionalities to the roof tile. As an advantage, it may be tailored, irrespective of the properties of the ceramic body. As another advantage, the layer may render it possible to reduce the thickness of the ceramic body, which may be beneficial to the overall weight of the roof tile. Still another advantage is that such layer may hold pieces or parts of the roof tile, which are damaged or broken off, due to heavy wind or hail storm for example, together. Said layer may thus function as a safety layer to prevent shards from falling from the roof.

Preferably, said layer situated below the ceramic body is made of a material different from ceramic or porcelain. In particular, said layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, high-density polyethylene or HDPE is preferred, although the use of low-density polyethylene or LDPE is not excluded. Another preferred material for the support layer is PVC, in particular rigid PVC. The support layer may also comprise a high amount of filler materials, such as talc, limestone, chalk, e.g. more than 30 wt % or more than 60% wt of such filler materials. The content of filler should be preferably limited to below 60 wt %, preferably below 50 wt % in order to avoid excessively increasing the brittleness of the support layer. Thereto, the support layer may preferably be made of SPC (solid polymer composite) that relates to a polymeric board, preferably in PVC, comprising solid particle filler, like limestone. If said support layer is made of a polymer, the layer may comprise one or more plasticizers. The one or more plasticizers may be present in an amount of less than 20 phr and, in this case, preferably in an amount between 5 phr and 15 phr. In this case, the support layer is of the so-called rigid type. In an alternative, the one or more plasticizers may be present in an amount of minimal 15 phr and, in this case, preferably in an amount of minimal 20 phr. In this case, the support layer is of the so-called soft type. It is to be noted that a rigid polymeric support layer is preferable above a flexible or soft polymeric support layer since it provides two main advantages. The first advantage is that the inventors have found that due to its rigidity the support layer interacts with the reinforcing layer thereby enhancing the reinforcing effect thereof. The second advantage is that a rigid support shows a limited thermal expansion coefficient that is closer to that of the ceramic body.

According to a preferred embodiment, the support layer is made of a rigid PVC. Preferably the rigid PVC may comprise a flexural modulus between 1.5 and 3.5 GPa, for example, approximately 2.6 GPa. The support layer may also comprise a flexural strength between 60 and 90 MPa, for example approximately 76 MPa. Moreover, the support layer may comprise a compressive strength between 40 and 70 MPa, for example approximately 56 MPa. In fact, inventors have found that the rigidity of the support layer helps absorbing the impact energy thereby improving the impact strength.

In a particular embodiment, said support layer may be foamed.

Said support layer may comprise a rigidity element, which is preferably embedded in the support layer. The rigidity element may concern a fiberglass layer, a mat or a fabric. As advantage, the rigidity element allows to increase the mechanical strength of the support layer and/or the stability thereof. In a particular embodiment, said support layer may comprise mineral fibers, such as glass fibers, which are not necessarily present in said layer situated below the ceramic body in the form of a layer.

According to an alternative embodiment the support layer may be made of an inorganic material. For example, the support layer may be made of cement, for example a Portland cement board, preferably a fiber cement board. The support layer may be also made of mineral board, like mica, magnesium oxide or other mineral boards.

Preferably, the thickness of the ceramic body is located between 25% and 75% of the thickness of the roof tile and more preferably between 40% and 60% of the thickness of the roof tile. The support layer situated below the ceramic body is preferably located between 25% and 75% and more preferably between 40% and 60% of the thickness of the roof tile. Preferably the thickness of the support layer is less than 10 mm, even more preferably less than 4 mm.

In an embodiment, at least a part of the layer situated below the ceramic body extends beyond the ceramic body in at least the width direction of the roof tile. For example, the ceramic body and said layer may be offset with respect to each other in at least the width direction of the roof tile. Preferably, at least a part of the support layer situated below the ceramic body extends beyond at least the upper edge of the ceramic body. In this case, at least a part of the ceramic body may extend beyond at least the lower edge of said support layer. In this way, it is obtained that the porcelain bodies of two of such roof tiles, installed in subsequent rows of the roof covering, may overlap, such that mainly only the porcelain bodies are exposed to outside conditions. This offers the advantage that the roof covering shows good properties in terms of weather and frost resistance. As another advantage, the amount of overlap between the porcelain bodies of two of such installed roof tiles in subsequent rows may be reduced.

In an embodiment, at least a part of the support layer extends beyond the ceramic body in at least the length direction of the roof tile. For example, the ceramic body and said support layer may be offset with respect to each other in at least the length direction of the roof tile. As advantage, it is obtained that the risk at water penetration may be reduced, since water penetrating the joint between two of such adjacent roof tiles in the same row of the roof covering may be caught by the underlying layers. Preferably, at least a part of the support layer extends beyond at least a side edge of the ceramic body, in the direction wherein multiple of such roof tiles are installed in a row of the roof covering. In this case, at least a part of the ceramic body may extend beyond at least a side edge of said layer, in the opposite direction. This provides the additional advantage of ease of installation.

In an embodiment, said part of the support layer that extends beyond a side edge of the ceramic body comprises channels for the drainage of water It is noted that at least part of the support layer may extend beyond the ceramic body in the length direction of the roof tile as well as in the width direction of the roof tile. For example, said support layer may be offset with respect to the ceramic body in the length direction of the roof tile as well as in the width direction of the roof tile.

Preferably, the upper and lower surface of said support layer may converge towards each other. In particular, they may converge towards each other in the direction towards the upper edge of said layer. For example, the upper surface of said support layer may be substantially parallel to the lower surface of the ceramic body, whereas the lower surface of said support layer may be configured such that, in the installed condition of the roof tile, it is substantially parallel to the slope of the roof. As advantage, the risk at breakage or damage of the roof tile, e.g. when walking over it, may be significantly reduced. In a particularly preferred embodiment, the lower surface of said support layer is arranged such that, in the installed condition of two of such roof tiles in subsequent rows of the roof covering, the lower surfaces of the respective layers of these two roof tiles form a generally flat surface. In other words, the transition from the lower surface of the support layer of one roof tile of these two roof tiles to the lower surface of the support layer of the other roof tile is flush or substantially flush. It is noted that in case of such converging surfaces the thickness of said support layer varies. In this case, where reference is made to the thickness of said support layer, this thickness should be interpreted as the average thickness of said support layer. The same applies to the thickness of the roof tile.

In a first possibility for the configuration of the support layer situated below the ceramic body, at least a part of said support layer extends beyond the ceramic body, which part is provided with one or more attachment holes. As such, the presence of any attachment holes in the ceramic body may be avoided, thereby reducing the risk at breakage or damage of the ceramic body upon installing. The layer may be tailored, irrespective of the ceramic body, such that it is strong enough to withstand any forces or pressure applied on it upon installing. In this regard, the aforementioned materials for the support layer are particularly advantageous. In particular, at least a part of said support layer may extend beyond the upper edge of the ceramic body, which part is provided with one or more attachment holes.

It is noted that according to said first possibility the attachment holes may comprise any of the features already described with reference to the ceramic body.

In a second possibility for the configuration of the support layer, the ceramic body and said layer are overlapped in a part that is provided with one or more attachment holes, wherein the attachment hole passes through the ceramic body and said support layer. For example, the second narrow part of the attachment hole comprises a portion in the ceramic body and a portion in the support layer. According to this configuration the support layer can improve the impact resistance thereof acting as a reinforcing member thereby minimizing the risk of breakage during the nailing step. Moreover, since both the ceramic body and the support layer are nailed together to the roof structure the risk of delamination between them, caused by wind lift up, is reduced.

Said support layer, at least at two opposite edges, can be provided with coupling parts, which allow that two of such roof tiles can be mechanically coupled to each other. Hereby, the advantage of easy installation is obtained, since the coupling parts may hold the roof tile in place for attaching or fastening it to the framework of the roof. As another advantage, the risk at water penetration may be reduced or eliminated, since the formation of gaps between roof tiles may be counteracted. Other advantages that may be obtained are improved impact resistance, improved uplift wind resistance and/or improved thermal insulation. Moreover, it is to be noted that by installing the roof tile to the supporting structure of the roof solely with the nails can cause leveling defects between roof tiles of the same row. This leveling issue can cause aesthetic defects in the roof covering and even expose the roof tiles to wind lift up. The mechanical coupling between roof tiles cause the roof tiles to be properly leveled each other.

Preferably, the opposite edges, at which the coupling parts are provided, concern the upper and lower edges of the support layer. In this case, the coupling parts allow coupling two of such roof tiles lying adjacent to each other in subsequent rows of the roof covering.

In an alternative embodiment, the opposite edges, at which the coupling parts are provided, concern the opposite side edges of the support layer. In this case, the coupling parts allow coupling two of such roof tiles lying adjacent to each other in a row of the roof covering.

It is noted that the upper and lower edges as well as the opposite side edges of the support layer may be provided with coupling parts.

In an embodiment, one of the opposite edges, with its associated coupling part, is situated, partially or completely, beyond the ceramic body, whereas the ceramic body extends, partially or completely, beyond the other edge of said opposite edges. In case the upper and lower edges as well as the opposite side edges of said support layer are provided with coupling parts, both pairs of edges may show the latter characteristic.

The aforementioned coupling parts may be performed according to one or more of the following possibilities, inasmuch these are not contradictory:

- the coupling parts are provided with a locking system, which, in the coupled condition of two of such roof tiles, is only active in the direction parallel to the plane of the roof covering and perpendicular to the coupled edges, which means that the moving apart of two of such coupled roof tiles in said direction is counteracted and preferably prevented. In an example, the coupling parts concern hook-shaped parts.
- the coupling parts are provided with a locking system, which, in the coupled condition of two of such roof tiles, is only active in the direction perpendicular to the plane of the roof covering, which means that the moving apart of two of such coupled roof tiles in said direction is counteracted and preferably prevented. In an example, the coupling parts concern a classical tongue and groove coupling.
- the coupling parts are provided with a locking system, which, in the coupled condition of two of such roof tiles, is active in the direction parallel to the plane of the roof covering and perpendicular to the coupled edges as well as in the direction perpendicular to the plane of the roof covering, which means that the moving apart of two of such coupled roof tiles in said directions is counteracted and preferably prevented;
- the coupling parts are free from locking systems. In an example, these coupling parts define an overlap between the respective layers of two of such coupled roof tiles.
- the coupling parts provide for a click-type or snap-type coupling;
- the coupling parts are configured such that they allow to couple two of such roof tiles by means of a downward movement of one roof tile with respect to the other, such as coupling parts of the so-called push-lock or push-down type, as in the field of flooring;
- the coupling parts are configured such that they allow to couple two of such roof tiles by means of a sliding movement one roof tile with respect to the other along the direction of the opposite edges, such as coupling parts of the dove-tail type.

In case of coupling parts being present at the upper and lower edges as well as at the opposite side edges of the support layer situated below the ceramic body, the coupling parts at the upper and lower edges may be of a different type than the coupling parts at the side edges, however, they may be identical as well.

Preferably, the coupling parts are substantially or completely formed from the material of the support layer. It is noted that the aforementioned materials for said layer show excellent properties for this purpose.

According to an alternative embodiment the coupling parts can be provided in the reinforcing layer, in case this is made according to the second possibility, i.e. in the metal plate. In this case the metal plate can extend beyond one or more edges of the ceramic body.

It is to be noted that a roof covering comprising a plurality of roof tile forms an independent aspect of the invention. Said roof tile can comprise one or more of the features described in relation to the first aspect.

The roof covering may further comprise an under layer disposed beneath the roof tiles. The under layer may provide additional functionalities to the roof tile. As advantage, it may be tailored, irrespective of the properties of the ceramic body. Preferably, said under layer is made of a material different from ceramic or porcelain. In particular, said under layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, HDPE is preferred, although the use of low density polyethylene or linear low density polyethylene LLDPE is not excluded.

According to a preferred embodiment of the invention, the under layer is a strip of polymeric material that is placed beneath a plurality of roof tile, in particular it is placed beneath a row of roof tile forming the covering. In this way the under layer is placed below the joints between the roof tiles of a same row thereby improving impermeability of the roof covering. Since the impermeability is improved because of the under layer, it is possible to reduce the overlap between the roof tile and, as a consequence the number of the roof tiles that are necessary for the roof covering. For example, due to this solution the roof tiles may be installed with an overlap of less than 35%, for example less than 25%. This reduced overlap provides for a significantly reduced number of roof tiles that is necessary for forming the roof covering and, as a consequence, for reducing the weight of the roof covering and the cost thereof. In fact the inventors have found that surprisingly a porcelain roof tile installed with said under layer is significantly lighter that an equivalent roof with traditional slate tiles even if slate is less dense than porcelain.

Figure 2:
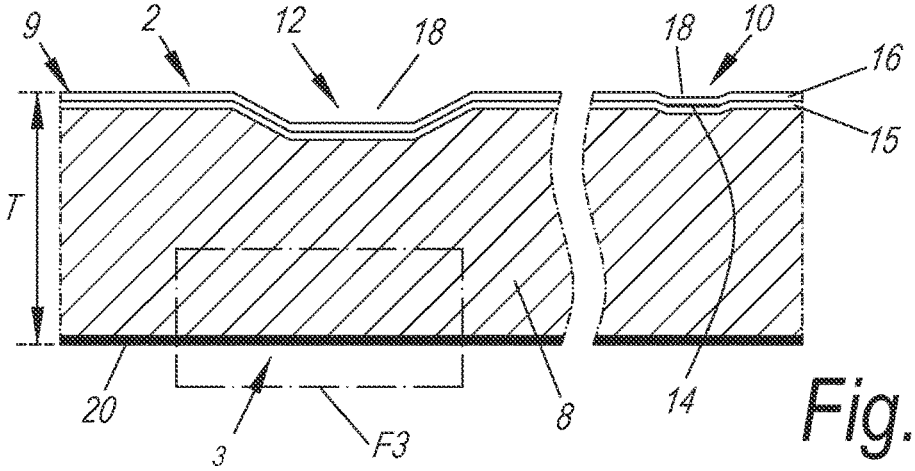
FIG. 2 represents an enlarged cross-section according to line II-II in FIG. 1.
Figure 3:
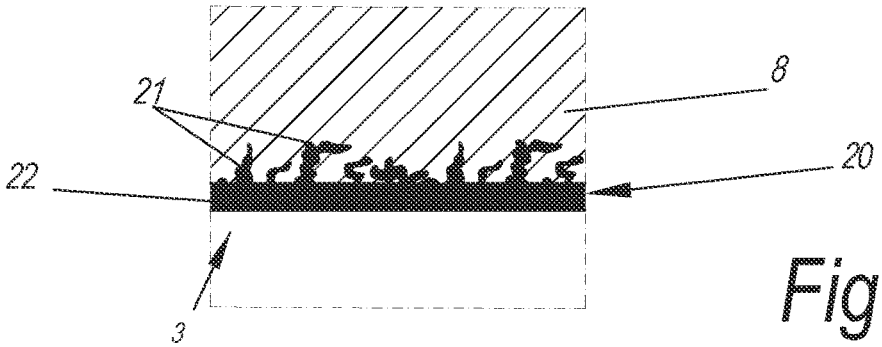
FIG. 3 represents an enlarged view of the section that is indicated with F3 in FIG. 2.
Figure 4:
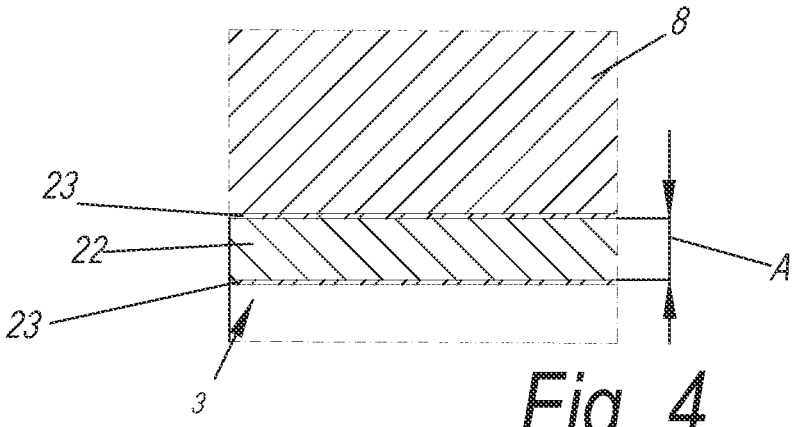
FIG. 4 represents an enlarged view of the section that is indicated with F3 in FIG. 2, according to a second embodiment.
Figure 5:
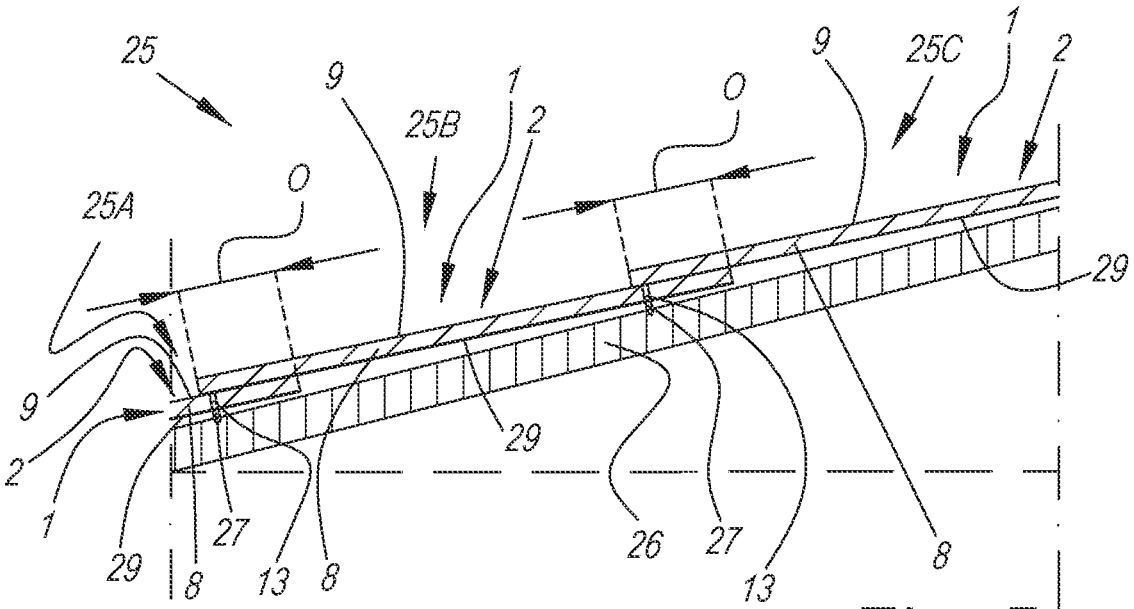
FIG. 5 represents a cross-sectional side view of part of an installed roof covering with roof tiles according to FIG. 1.
Figure 6:
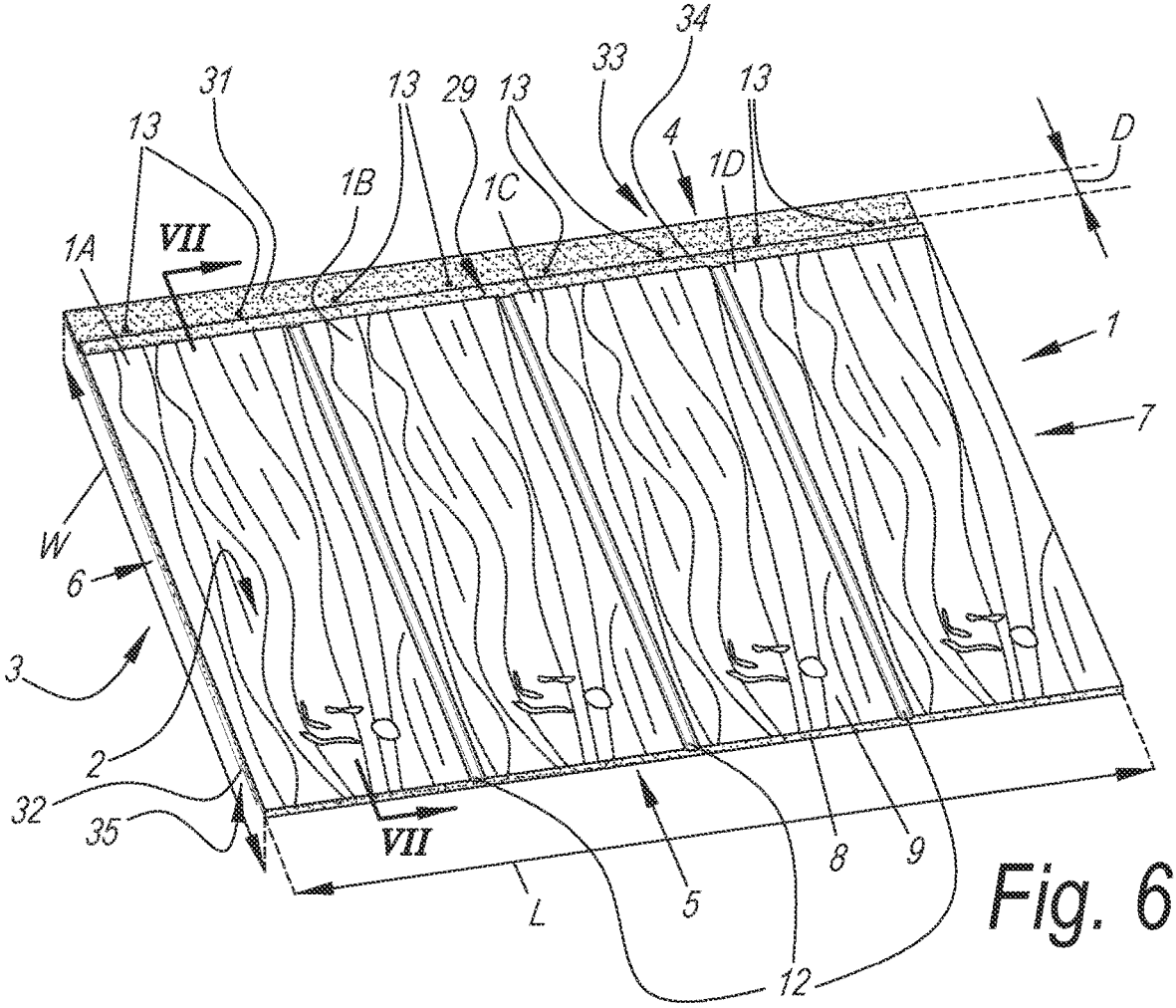
FIG. 6 represents a perspective view of a roof tile according to the present invention, with a view on the front face of the roof tile.
Figure 8:
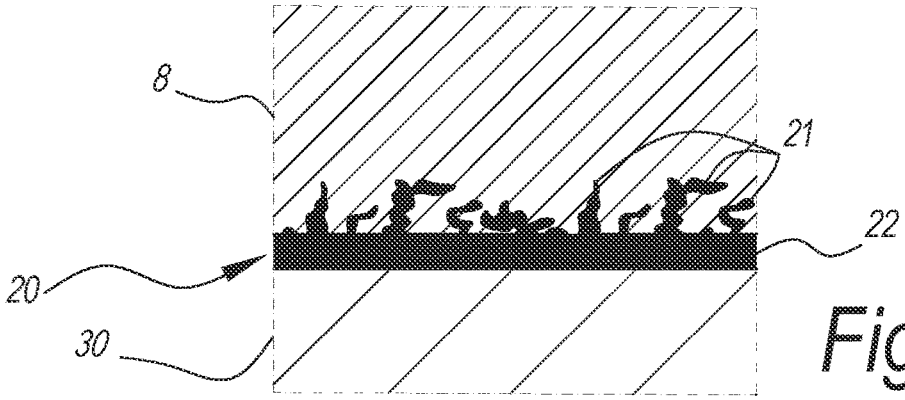
FIG. 8 represents an enlarged view of the section that is indicated with F8 in FIG. 7.
Figure 7:
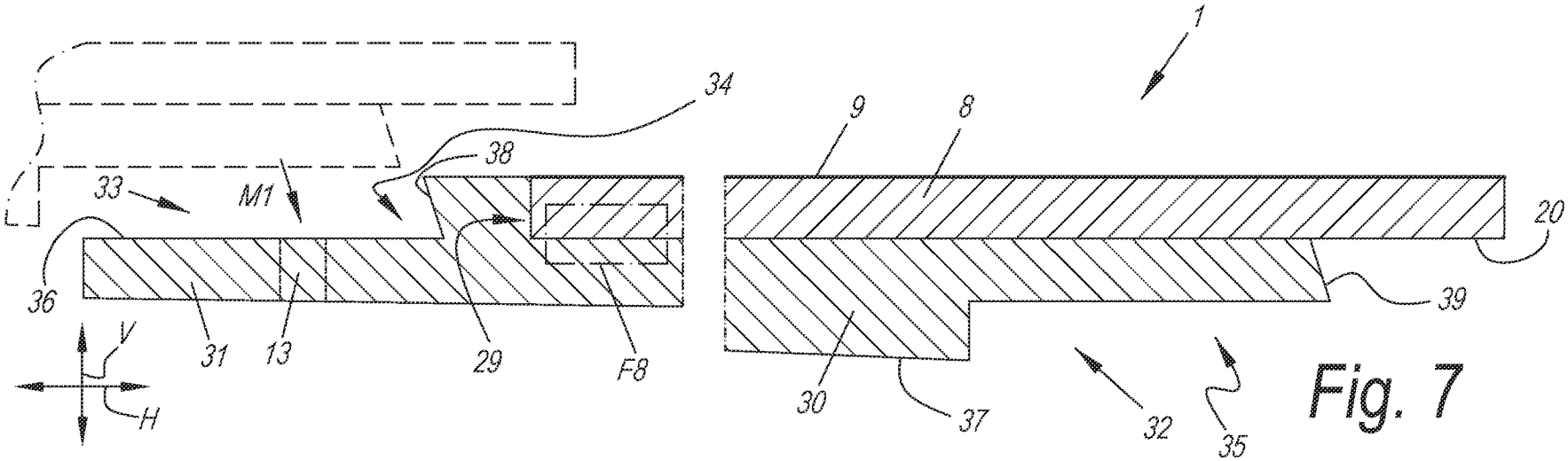
FIG. 7 represents an enlarged cross-section according to line VII-VII in FIG. 6.
Figure 9:
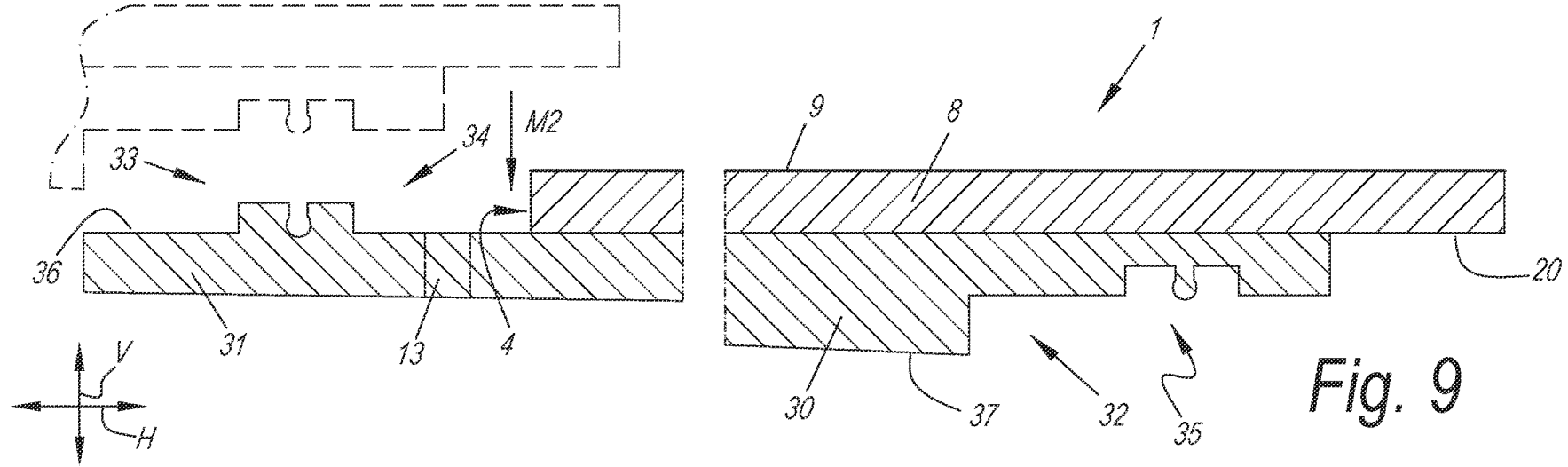
FIG. 9 represents an enlarged cross-section according to line VII-VII in FIG. 6, in an alternative configuration.

With the intention of better showing the characteristics of the invention, in the following, as an example without any limitative character, several preferred forms of embodiments are described with reference to the accompanying drawings, wherein:

FIG. 1 represents a perspective view of a roof tile according to a first embodiment of the present invention, with a view on the front face of the roof tile;

FIG. 2 represents an enlarged cross-section according to line II-II in FIG. 1;

FIG. 3 represents an enlarged view of the section that is indicated with F3 in FIG. 2;

FIG. 4 represents an enlarged view of the section that is indicated with F3 in FIG. 2, according to a second embodiment;

FIG. 5 represents a cross-sectional side view of part of an installed roof covering with roof tiles according to FIG. 1;

FIG. 6 represents a perspective view of a roof tile according to the present invention, with a view on the front face of the roof tile;

FIG. 7 represents an enlarged cross-section according to line VII-VII in FIG. 6;

FIG. 8 represents an enlarged view of the section that is indicated with F8 in FIG. 7;

FIG. 9 represents an enlarged cross-section according to line VII-VII in FIG. 6, in an alternative configuration.

FIG. 1 represents a perspective view of a roof tile 1 according to the present invention, with a view on the front face of the roof tile 1.

The roof tile 1 is mainly rectangular and, in the represented example, rectangular and oblong. It has an upper surface 2 and a lower surface 3, whereby, in the installed condition of the roof tile 1, the upper surface 2 is directed upwards, whereas the lower surface 3 is directed downwards. The upper surface 2 forms the decorative surface of the roof tile 1.

Furthermore, the roof tile 1 has an upper edge 4 and a lower edge 5, whereby, in the installed condition of the roof tile 1, the upper edge 4 is directed towards the top of the roof, whereas the lower edge 5 is directed towards the bottom of the roof. Also, the roof tile 1 has two opposite side edges 6-7.

In the illustrated embodiment, the roof tile 1 comprises a ceramic body 8, which is made of porcelain, and a glaze coating 9, which is situated above said ceramic body 8.

The glaze coating 9 comprises a décor, which here simulates wood. In particular, the décor shows wood nerves and wood pores. It is to be noted that the décor 10 may represent any desired graphic, for example natural stone, slate etc. It is also to be noted that the décor 10 is printed, more preferably digitally inkjet printed using ceramic pigments.

In the represented example, the front face of the roof tile 1 represents or forms an image of a plurality of roof tiles 1A-1B-1C-1D. The borders or transitions between the roof tiles 1A-1B-1C-1D are formed by depressions 12, which form part of the relief at the upper surface 2 of the roof tile 1. Alternatively, said transition can be simulated by the printed décor 10.

Although, in the represented example, the front face 2 of the roof tile 1 represents or forms an image of four roof tiles 1A-1B-1C-1D, it is contemplated that less than four roof tiles are represented, such as two or three roof tiles, and it is contemplated that more than four roof tiles are represented.

The thickness T of the roof tile 1 is less than 10 mm, for example less than 8 mm, more preferably less than 6 mm. The thickness T is greater than 1 mm, preferably higher than 3 mm.

The length L of the roof tile 1 is larger than its width W. The length L of the roof tile 1 may be at least 250 mm and preferably at least 500 mm. it is to be noted that the length L of the roof tile 1 correspond to the upper edge 4 and the lower edge 5, and defines that dimension that is destined to be placed horizontally in use.

The roof tile 1 is provided with at least one attachment hole 13. Here, the roof tile 1 is provided with a plurality of attachment holes 13. The attachment holes 13 are present in at least the ceramic body 8 of the roof tile 1. They are situated closer to the upper edge 4 of the roof tile 1 than to the lower edge 5 of the roof tile 1. In particular, the attachment holes 13 are situated at a distance D from the upper edge 4, measured in the width direction of the roof tile 1, which is smaller than 0.25 times the width W of the roof tile 1. The minimal width or diameter of the attachment holes 13 is smaller than the thickness T of the roof tile 1. The attachment hole 13 is a through hole that passes through the entire thickness T of the roof tile 1.

FIG. 2 represents an enlarged cross-section according to line II-II in FIG. 1.

The glaze coating 9 comprises a décor 10, said décor comprising a print 14, a glaze layer 15 of uniform color, which is situated below the print 14, and a transparent or translucent glaze layer 16, which is arranged over said print 14. It is noted that according to alternative examples the glaze coating 9 may be free from said transparent or translucent glaze layer 16 and/or from said print 14. In further alternative embodiments a glaze coating may absent and the print 14 and the relief may be provided at the upper surface 2 of the ceramic body 8. It is also noted that the glaze coating 9 may comprise a print 14 at least partially provided above said transparent or translucent glaze layer 16.

The upper surface 2 of the roof tile 1 is provided with a relief, which, in the represented example, is formed by a plurality of excavations 18 present in said upper surface 2. According to the present embodiment the relief is formed in the ceramic body 8 and manifest itself through the glaze coating 9, although according to non-showed embodiments the relief may be at least partially formed directly in the glaze coating 9.

Here, the relief is also used to represent the borders or transitions between the roof tiles 1A-1B-1C-1D, which, as aforementioned, are formed by the depressions 12 in the upper surface 2 of the roof tile 1.

In the example, the relief is performed in register with the print 14.

FIG. 2 further shows that the roof tile 1 comprises a reinforcing layer 20 attached to the lower surface 3 of the ceramic body 8.

FIG. 2 shows the reinforcing layer 20 in a first preferred embodiment wherein it comprises a resin material, for example a thermosetting resin or thermoplastic resin. Examples of thermosetting resin are epoxy, polyurethane, cyanoacrylate, unsaturated polyester, vinyl ester or acrylic resin. It is to be noted that in this example the reinforcing layer 20 is constituted by the resin. Examples of thermoplastic resin are reactive hot melt, hot melt, polyester thermoplastic, vinyl etc. Preferably the resin is a rigid resin. In particular, according to a preferred embodiment of the invention the reinforcing layer 20 comprises an epoxy resin. It is also preferred that the epoxy is a bicomponent resin, i.e. a thermosetting resin obtained by curing at low temperature (for example at room temperature) a mixture of two components, namely a resin and a hardener.

The resin preferably comprises a tensile strength between 50 and 90 MPa, more preferably between 60 and 80 MPa, for example 75 MPa. Moreover, the resin preferably comprises a compressive strength between 90 and 130 MPa, more preferably between 100 and 120 MPa, for example 110 MPa. It is also preferable that the resin shows a hardness value of at least 50 measured on a Shore D scale.

As illustrated the reinforcing layer 20 covers the 100 percent of the lower surface of the ceramic body 8. The resin is preferably provided onto the lower surface 3 of the porcelain layer 8 in an amount above 150 g/sqm, more preferably above 200 g/sqm, for example 220 g/sqm.

FIG. 3 on a larger scale shows a view on the area F3 indicated on FIG. 2. As illustrated in FIG. 3 the ceramic body 8 comprises, at least in correspondence of its lower surface 3, an open porosity 21 adapted to be permeated by the resin of the reinforcing layer 20.

Thus, according to a preferred embodiment of the invention, the ceramic body 8 comprises an apparent porosity between 0.1% and 10% determined according to ASTM C373, more preferably between 2% and 8%, for example 6%. Furthermore, the ceramic body 8 may preferably have a volume of the open pores 21 comprised between 0.01 cc (cubic centimeter) and 1 cc, more preferably between 0.10 cc and 0.90 cc, for example 0.60 cc.

Preferably, in order to properly flow into said open pores 21 the resin of the reinforcing layer 20 comprises a viscosity at 20° C. less than 1000 mPas, preferably less than 800 mPas, more preferably less than 600 mPas, for example approximately 400 mPas. Within the scope of the invention "viscosity" means the viscosity of the uncured resin, for example the viscosity of the mixture of the two components before the completion of the curing, i.e. during the so-called pot life.

FIG. 4 represents a second embodiment of the roof tile 1 wherein the reinforcing layer 20 comprises a metal plate 22.

Preferably, the metal plate 22 is made of steel. The metal plate 22 is configured to produce a compressive state in the ceramic body 8 starting from the lower surface 3 thereof. In this way, since the ceramic body 8 is in a compressive state, a major improvement in the impact resistance is obtained. In order to achieve this goal, the metal plate 22 is firstly tensioned (stretched or elongated) by means of a mechanical or thermal stretching action and is then arranged underneath the ceramic body 8 while it is still in the elongated state. Then the stretched condition is released, by interrupting the mechanical stress or cooling the metal plate 22, so as to cause compression of the ceramic body 8.

According to a preferred embodiment, the metal plate 22 has a thermal expansion coefficient greater than the thermal expansion coefficient of the ceramic body 8. Owing to this solution the metal plate 22 may be stretched by means of heating so as to expand in a substantially uniform manner in every direction. After the metal plate 22 has been arranged underneath the ceramic body 8 it may be cooled down so as to contract and cause compression of the ceramic body 8.

Furthermore, the metal plate 22 comprises one or more protective coatings 23, each designed to cover at least partially, or better entirely, the metal plate 22 so as to protect it from corrosion. In particular, according to the example shown, the metal plate 22 is of the PPGI (Pre-Painted Galvanized Iron) or PPGL (Pre-Painted GlavaLume) type. This abbreviation is understood as meaning metal (not necessarily steel) plates which are galvanized (covered with a zinc or aluminium layer) and painted. Preferably, the metal plate 22 is lined on one or both its surfaces with a first layer of zinc, optionally a chrome-plated layer, and one or more protective coatings 23 of paints or sealing membranes, for example polymer material consisting of epoxy resin, polyesters, polyurethanes, polyvinyls or polyolefins.

According to a preferred embodiment shown in FIG. 4, the metal plate 22 has a thickness A less than 1 mm, preferably less than 0.5 mm even more preferably less than 0.2 mm. The metal plate 22 has a thickness A greater than 0.05 mm, preferably greater than 0.1 mm.

The metal plate 22 is attached to the lower surface of the ceramic body 8 by means of an adhesive. Said adhesive can is preferably a polyurethane or a hot melt glue.

FIG. 5 represents a cross-sectional side view of part of an installed roof covering 25 with roof tiles 1 according to FIG. 1.

The roof tiles 1 are attached or fastened to a framework 26 by means of nails 27, which are put in the attachment holes 13.

The roof tiles 1 are installed in subsequent rows, of which only a few are represented in FIG. 7, namely the subsequent rows 25A-25B-25C. In particular, the roof tiles 1 are installed such that the roof tiles 1 of one row partially overlap the roof tiles 1 of a previous row. For example, the roof tiles 1 of row 25C and 25B respectively overlap the roof tiles 1 of previous row 25B and 25A.

The overlap O between the roof tiles 1 of the respective rows is less than 50%, preferably less 35%. Or, in other words, the roof tiles 1 of row 25C and 25B respectively overlap the roof tiles 1 of previous row 25B and 25A, whereby the overlap O is such that less than 35% of the upper surface 2 of the roof tiles 1 of row 25A and 25B is covered by the roof tiles 1 of row 25B and 25C respectively.

The roof covering 25 comprises a plurality of under layers 29, in form of strips placed beneath a row 25A-25B-25C of roof tile. In particular, each strip of under layer 29 is placed beneath one row 25A-25B-25C. Said under layer 29 is made of a material different from ceramic or porcelain. In particular, said under layer 29 is be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said under layer 29, low-density polyethylene or HDPE is preferred, although the use of high-density polyethylene or LDPE is not excluded.

FIG. 6 represents a perspective view of an alternative roof tile 1 according to the present invention, with a view on the front face of the roof tile 1.

The roof tile 1 comprises a support layer 30, which is situated below the ceramic body 8 so that the reinforcing layer 20 is disposed between the ceramic body 8 and the support layer 30.

Said support layer 30 is preferably made of a material different from ceramic or porcelain. In particular, it is preferred that said support layer 30 is made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer.

In the illustrated example the support layer 30 is PVC, in particular rigid PVC. The support layer 30 may also comprise a high amount of filler materials, such as talc, limestone, chalk, e.g., more than 30 wt % or more than 60% wt.

Preferably the rigid PVC may comprise a flexural modulus between 1.5 and 3.5. GPa, for example, approximately 2.6 GPa. The support layer 30 may also comprise a flexural strength between 60 and 90 MPa, for example approximately 76 MPa.

The support layer 30 has a part 31 which extends beyond the ceramic body 8. In the represented example, the part 31 extends beyond the upper edge 4 of the ceramic body 8. Further, in the present embodiment the ceramic body 8 extends beyond a lower edge 32 of said support layer 30.

The support layer 30, at least at two opposite edges, in this case an upper edge 33 and the lower edge 32, is provided with coupling parts 34-35, which allow that two of such roof tiles 1 can be coupled to each other.

In fact, as illustrated in FIG. 7, the support layer 30 and the ceramic body 8 are offset with respect to each other in the width and/or length direction of the roof tile 1, in this case in the width W.

In this embodiment the attachment holes 13 pass through the thickness of the support layer 30 and are preferably entirely realized in the support layer 30.

The support layer 30 and the ceramic body 8 may be laminated or press laminated together, for example by means of an adhesive.

In a preferred embodiment wherein the reinforcing layer 20 comprises a resin as illustrated in FIG. 3, said resin of the reinforcing layer can act as the adhesive to bond together the ceramic body and the support layer, as illustrated in FIG. 8.

In a preferred embodiment wherein the reinforcing layer 20 comprises a metal plate 22 as illustrated in FIG. 3 and the support layer 30 is attached to the metal plate 22 via an adhesive that can be the same used to attach the metal plate 22 itself to the ceramic body 8.

Coming back to FIG. 7, the ceramic body 8 forms between 25% and 75% of the thickness T of the roof tile 1 and preferably between 40% and 60% of the thickness T of the roof tile 1. The support layer 30 forms between 25% and 75% of the thickness T of the roof tile 1 and preferably between 40% and 60% of the thickness T of the roof tile 1.

In a preferred illustrated embodiment, the support layer 30 has an upper surface 36 and a lower surface 37 that converge towards each other. In particular, they converge towards each other in the direction towards the upper edge 33 of said support layer 30 so that the thickness of the support layer 30 is higher in proximity of the lower edge 32 than in proximity of the upper edge 33.

In the represented example, the coupling parts 34-35 are formed in the material of the support layer 33. They are provided with a locking system, which, in the coupled condition of two of such roof tiles 1, is only active in the direction V perpendicular to the plane of the roof covering, which means that the moving apart of two of such coupled roof tiles 1 in said direction V is counteracted and preferably prevented. The locking system comprises locking surfaces 38-39, which, in the coupled condition, cooperate with each other to counteract the moving apart of the coupled roof tiles 1 in said direction V.

The coupling parts 34-35 are configured such that they allow to couple two of such roof tiles 1 by means of a substantially downward movement M1 of one roof tile 1 with respect to the other roof tile 1.

FIG. 9 represents a variant of the embodiment of FIG. 7.

In the represented example, the coupling parts 34-35 are provided with a locking system, which, in the coupled condition of two of such roof tiles 1, is active in the direction H parallel to the plane of the roof covering and perpendicular to the coupled edges 32-33 as well as in the direction V perpendicular to the plane of the roof covering, which means that the moving apart of two of such coupled roof tiles 1 in said directions H and V is counteracted and preferably prevented.

Here, the coupling parts 34-35 provide for a click-type or snap-type coupling. This means that a click or snap action occurs upon coupling two of such roof tiles at the respective edges 32-33.

The coupling parts 34-35 are configured such that they allow to couple two of such roof tiles 1 by means of a downward movement M2 of one roof tile 1 with respect to the other roof tile 1. In the example, they are of the so-called push-lock or push-down type.

The present invention is in no way limited to the hereinabove described embodiments, but such system may be realized according to different variants without leaving the scope of the present invention.

Further, as is clear from the content of the description, the present invention relates to one or more of the items as listed below, numbered from 1 to 20:

1. A roof tile comprising a ceramic body and a reinforcing element attached to a lower surface of the ceramic body.
2. Roof tile according to item 1, wherein the reinforcing layer comprises a resin.
3. Roof tile according to item 2, wherein said resin comprises a viscosity less than 1000 mPas at 20° C.
4. Roof tile according to any of the items 2 or 3, wherein said resin comprises a tensile strength between 50 and 90 MPa.
5. Roof tile according to any of the items from 2 to 4, wherein said resin comprises a hardness greater than 50 Shore D.
6. Roof tile according to any of the items from 2 to 5, wherein said resin is provided in an amount greater than 50 g/sqm.
7. Roof tile according to any of the items from 2 to 6, wherein said resin comprises epoxy, polyurethane, acrylic and/or polyester resin.
8. Roof tile according to item 1, wherein the reinforcing comprises a metal plate.
9. Roof tile according to item 8, wherein the metal plate is attached to the bottom of the ceramic body in a stretched state so that after releasing the stretch the metal plate compresses the ceramic body.
10. Roof tile according to any of items 8 or 9, wherein the metal plate comprises a thickness less than 1 mm, preferably less than 0.5 mm, more preferably less than 0.2 mm.
11. Roof tile according any of the preceding items, wherein the roof tile comprises a support layer attached below the reinforcing layer.
12. Roof tile according to item 11, wherein said support layer is made of SPC.
13. Roof tile according to any of items 11 or 12, wherein the roof tile comprises at least an attachment hole provided in the support layer.
14. Roof tile according to any of the items from 11 to 13, wherein said support layer comprises a thickness less than 4 mm.
15. Roof tile according to any of the items from 11 to 14, wherein the support layer comprises locking elements adapted to provide a mechanical coupling with the locking elements of an adjacent roof tile.
16. Roof tile according to item 15, wherein said locking element are configured to prevent vertical movement between the roof tile and said adjacent roof tile.
17. Roof tile according to any of the preceding items, comprising at least an attachment hole provided in the ceramic body.
18. Roof tile according to any of the preceding items, wherein the ceramic body comprises a thickness less than 8 mm, preferably less than 6 mm.
19. Roof tile according to any of the preceding items, wherein the roof tile comprises a weight less than 20 kg/sqm.

20. Roof tile according to any of the preceding items, wherein the roof tile comprises a rectangular shape and a top décor imitating a plurality of roof tiles.

While several possible embodiments are disclosed above, embodiments of the present invention are not so limited. These exemplary embodiments are not intended to be exhaustive or to unnecessarily limit the scope of the invention, but instead were chosen and described in order to explain the principles of the present invention so that others skilled in the art may practice the invention. Indeed, various modifications of the invention in addition to those described herein will become apparent to those skilled in the art from the foregoing description. Such modifications are intended to fall within the scope of the appended claims.

What is claimed is:

1. A roof tile comprising a ceramic body, a reinforcing element attached to a lower surface of the ceramic body, and a support layer attached below the reinforcing element, wherein the reinforcing element consists of a resin, wherein the resin covers 80 percent or more of the lower surface of the ceramic body, wherein the support layer comprises a rigid polymer with embedded fiberglass, wherein the support layer comprises coupling parts adapted to provide for attachment of the roof tile to a roof framework, and wherein the coupling parts provide for a click-type or snap-type coupling.

2. The roof tile according to claim 1, wherein the resin comprises a viscosity less than 1,000 mPas at 20° C. when the resin is uncured.

3. The roof tile according to claim 1, wherein said resin comprises a tensile strength between 50 and 90 MPa after curing.

4. The roof tile according to claim 1, wherein said resin comprises a hardness above 50 Shore D after curing.

5. The roof tile according to claim 1, wherein said resin is provided, when the resin is uncured, in an amount above 50 g/sqm.

6. The roof tile according to claim 1, wherein said resin comprises epoxy, polyurethane, acrylic and/or polyester resin.

7. The roof tile according to claim 1, wherein the support layer is made of a solid polymer composite (SPC).

8. The roof tile according to claim 1, wherein the roof tile comprises at least an attachment hole provided in the support layer.

9. The roof tile according to claim 8, wherein the coupling parts comprise the attachment hole.

10. The roof tile according to claim 1, wherein the support layer comprises a thickness below 4 mm.

11. The roof tile according to claim 1, wherein the coupling parts are adapted to provide a mechanical coupling with the coupling parts of an adjacent roof tile.

12. The roof tile according to claim 11, wherein the coupling parts are configured to prevent vertical movement between the roof tile and said adjacent roof tile.

13. The roof tile according to claim 11, wherein the coupling parts are adapted to provide the mechanical coupling of the roof tile to the adjacent roof tile by movement of the roof tile relative to the adjacent roof tile.

14. The roof tile according to claim 1, comprising at least an attachment hole provided in the ceramic body.

15. The roof tile according to claim 1, wherein the ceramic body comprises a thickness below 8 mm, preferably below 6 mm.

16. The roof tile according to claim 1, wherein the roof tile comprises a weight below 20 kg/sqm.

17. The roof tile according to claim 1, wherein the roof tile comprises a rectangular shape and a top décor imitating a plurality of roof tiles.

18. The roof tile according to claim 1, wherein the coupling parts are formed in the support layer.

19. The roof tile according to claim 1, wherein the coupling parts are at least substantially formed from the rigid polymer embedded with fiberglass.

20. The roof tile according to claim 1, wherein the resin covers about 100 percent of the lower surface of the ceramic body.

* * * * *